United States Patent [19]

Thurston

[11] 4,270,828

[45] Jun. 2, 1981

[54] IMPROVED CAPACITOR LEAD CLIPS

[75] Inventor: George T. Thurston, Glens Falls, N.Y.

[73] Assignee: General Electric Company, Hudson Falls, N.Y.

[21] Appl. No.: 86,848

[22] Filed: Oct. 22, 1979

[51] Int. Cl.[3] ..... H01R 4/24

[52] U.S. Cl. ..... 339/95 R; 339/97 C

[58] Field of Search ..... 339/95 R, 96, 97 R, 339/97 C, 98, 99 R; 174/84 C

[56] References Cited

U.S. PATENT DOCUMENTS

| | | | |
|---|---|---|---|
| 2,583,530 | 1/1952 | Hasselbohm | 339/95 R |
| 3,395,381 | 7/1968 | Huffnagle | 339/97 C |
| 3,715,457 | 2/1973 | Teagno et al. | 339/97 R |
| 3,752,901 | 8/1973 | Kuo | 174/84 C |
| 3,767,841 | 10/1973 | Anderson et al. | 339/97 C |
| 4,012,101 | 3/1977 | Damoisiaux et al. | 339/97 C |
| 4,082,402 | 4/1978 | Kinkaid et al. | 339/97 C |
| 4,106,836 | 8/1978 | Asick et al. | 339/97 C |

*Primary Examiner*—John McQuade

*Attorney, Agent, or Firm*—J. J. Lichiello

[57] ABSTRACT

A clip for electrical conductors comprises a generally rectangular metal strip with piercing tangs projecting from each end. The strip is folded into a triangular configuration which is used to encircle the conductors. At the apex the piercing tangs are folded inwardly and abut each other. An anvil tool at the apex forces the tangs to penetrate the conductors while the tangs support each other in abutting relationship and there enter a central aperture in the base of the clip for a clinching action.

10 Claims, 10 Drawing Figures

IMPROVED CAPACITOR LEAD CLIPS

This invention relates to electrical connectors and more particularly to a piercing clip or clamp connection for plural electrical conductor straps.

BACKGROUND OF THE INVENTION

In the electrical arts there is always a need for an improved clip type connector which is expedient to use, economical, and provides a positive, safe, and reliable electrical connection. In the electrical capacitor art these connectors also must withstand the passage of up to about 100,000 amps passing through the connection, and such high currents exert very high mechanical disrupting forces on the connector. Typical clip type connectors of the prior art are shown in U.S. Pat. No. 3,138,658 and 3,541,226, which disclose metal clip type connectors of a general V or VU configuration which fold over a stack of thin laminate connectors and clamp or crimp the connectors together. Piercing projections may be employed on the inner surfaces of the clip to pierce some or all of the connectors to retain them in assembled relationship.

In the application of prior art clips to plural tap strap leads of high voltage power capacitors several disadvantages were encountered. The prior art clips were difficult to handle and required considerable care in positioning, presetting and crimping. In some cases, the tap straps would skewer out of alignment in the clip making the crimping process quite difficult. In some instances difficulties of crimping were so great that there was insufficient piercing of the tap straps by the clip. Furthermore, the number of tap straps which could be effectively retained and pierced was limited and less than optimum connections, even with a reduced number of tap straps, could not withstand high current loads.

SUMMARY OF THE INVENTION

The clip of the present invention provides balanced encircling means to encircle a stack of tap straps to first positively grip and retain tap straps in fixed alignment, and opposed piercing tangs which support each other during the piercing operation to provide a greatly improved clip.

BRIEF DESCRIPTION OF THE DRAWINGS

This invention will be better described with reference to the following drawings in which.

DESCRIPTION OF PREFERRED EMBODIMENTS

Figure 1:
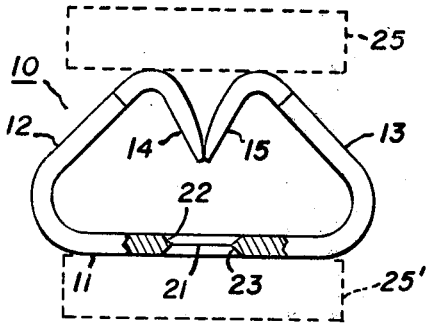
FIG. 1 is an end elevational view of a preferred embodiment of this invention.
Figure 2:
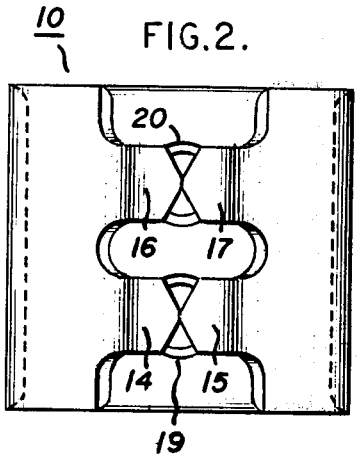
FIG. 2 is a top view of the clip of FIG. 1.

Referring now to FIG. 1 the basic clip 10 of this invention, in one preferred form, comprises a general rectangular steel strip member having a laterally extending base member 11 and each end of which is folded upwardly to provide opposite upstanding arm members 12 and 13. Each of the arm members 12 and 13 terminate in laterally spaced opposing pairs of inturned piercing tangs 14 and 15 (and 16 and 17 as illustrated in FIG. 2). Arm members 12 and 13 are equally folded over past their vertical center line a sufficient distance so that a generally triangular cross sectional configuration of clip 10 is attained. The internal angles of the sides of this triangle are less than 90° and preferably on the order of 45°, with the horizontal.

Figure 3:
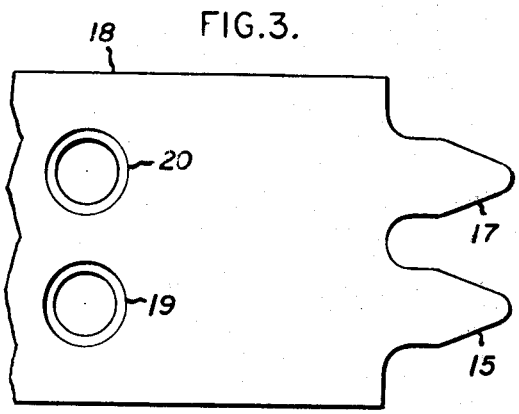
FIG. 3 is a top view of the parent metal strip prior to its bending into a clip form.

The clip 10 of the invention is first cut or stamped a parent strip into the configuration illustrated in FIG. 3. Referring now to FIG. 3 the flat strip 18 is provided with a pair of centralized necked apertures 19 and 20 and opposed cut out pairs of piercing tangs 15 and 17 (14 and 16 not shown) which are oppositely positioned on each end of the strip 18. Piercing tangs 14–17 have sharpened points which are made sharp in the stamping or cutting process of making the FIG. 3 pattern. As illustrated in FIG. 2 the strip 18 is folded to provide the basic triangular clip 10 of this invention as illustrated in FIG. 1.

The piercing tangs 14, 15, 16 and 17 are inwardly turned more than 90° from original plane of the arm members 12 and 13 and ordinarily at an angle of about 105° therewith. The relationship of the arm and piercing tang angles provides that the opposite piercing ends meet in a preferable abutting relationship in an outward V configuration pointing towards the apertures 19 and 20 in base element 11. It is imperative that the piercing tangs are sufficiently rigid so that in their opposed relationship the acting forces thereon do not alter their desired bending characteristics or their ability to deform the triangular shape in the crimping operation. Apertures 19 and 20 are located directly under the piercing ends 14–17 of the base element and are designed to be mechanically receptive to the piercing ends 14–17 without the need for any upstanding sidewall or tooth portions. Apertures 19 and 20 are necked apertures and, as illustrated in FIG. 1, have a central necked down ring portions 21, and outwardly oppositely flaring portions 22 and 23. The number of piercing ends and apertures may be varied to meet the needs of the particular material being joined. A pair of piercing ends and one aperture may be appropriate while two or more of each may be applicable in other circumstances. A preferred clip will have two opposed pairs of tangs and two apertures. As understood from FIG. 3 the strip 18 comprises, at each end a lateral row of piercing tangs which project axially in the plane of the strip. A similar configuration is provided on the opposite end of strip 18. A centerline drawn through one tang at one end of the strip to its opposed tang at the other end of the strip also passes through the center of an aperture.

Figure 4:
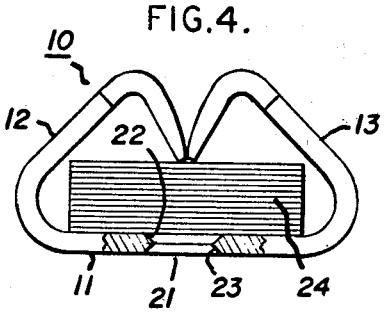
FIG. 4 is a working sectional view of the clip of FIG. 1 with inserted electrical conductors.
Figure 5:
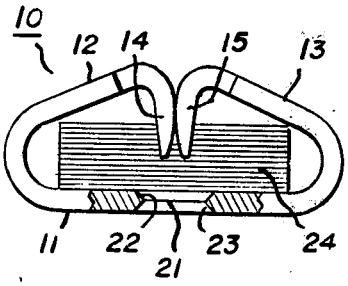
FIG. 5 is a progressive view of the FIG. 4 clip arrangement showing the tangs piercing the taps.
Figure 6:
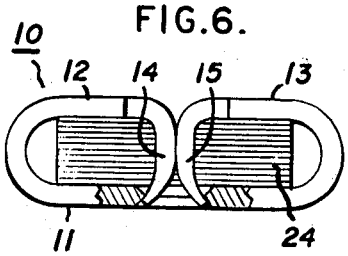
FIG. 6 is a progressive view of the FIG. 5 arrangement showing a completely crimped clip assembly.

The crimping action of the clip 10 of this invention is best described with respect to FIGS 4–6. Referring now to FIG. 4 a clip 10 is illustrated as surrounding a stack of metal tap straps or ribbons 24 which may comprise as many as 30 individual straps, for example of aluminum and 0.0035 inches thick. The clip 10 of this invention has its base 11 parallel to and supporting the straps 24 while the two arm members 12 and 13 enclose the sides of the stack to prevent skewing. The stack of strips 24 is fully supported and gripped by the clip prior to the piercing tang engaging operation. The clip 10 is self supporting in this position. It engages and surrounds the tap straps and requires no further means to prevent lateral motion as would be the case with prior art folding clips. A suitable compressing tool or vise is brought to bear on the clip along its vertical axis to push the piercing tangs perpendicularly towards apertures 19 and 20. The symmetrical clip 10 does not require any specially formed crimping tool, a pair of simple flat rams or anvils 25 and 25' as illustrated by the dash lines in FIG. 1 is adequate. The total piercing and crimping action is carried on inside the triangular configuration and the abutting forces of the piercing ends automatically forms the clip 10 to the final configuration.

As the opposed piercing tangs begin their inward movement, they are in abutting relationship to each other and thereby structurally support each other to prevent movement out of their prescribed trajectory as illustrated in FIG. 5. As the piercing action by the supporting tangs commences, the arms 12 and 13 encircle the stack to maintain effective alignment of the tap straps for the piercing action and to support each other in a rigid V penetration formation. As the piercing action progresses, the arms 12 and 13 are forced progressively laterally as the piercing edges approach and enter aperture 19 and 20. Accordingly, the lateral dimension of the clip is slightly increased but the supporting action of the abutting tangs is preserved throughout the total operation.

Apertures 19 and 20 are somewhat larger than piercing tangs 14–17 and their flared portions permit a depression of the tap straps into the aperture just prior to penetration. This concept maintains alignment just prior to final penetration while the outwardly flared portion coincides with the final clinched position of the piercing ends as shown in FIG. 6 wherein the tangs grip the necked down portion of the apertures.

In the present invention the tangs do the total penetration function and are turned over at their ends for clinching action. The clip 10 of this invention dispenses with the need for the apertures to be surrounded by teeth-like projections to pierce or frictionally engage the tap straps.

The triangular configuration of clip 10 together with a balancing of forces in the clip contributes a symmetry of design and operation. For example, the symmetrical and triangular clip of this invention provides equal and opposing arm member forces that confine bending of the clip to the part of arm members 12 and 13 which encircle the stack, and stabilize the piercing ends for straight through piercing of the stack to apertures 18 and 19. It also provides a capability of incorporating an increased number of tap straps without skewing, fracturing, and with positive piercing.

Best results have been attained when the upstanding arm members, without the tangs are about one-half the length of the base member 11. On the other hand the tangs are of significantly less length than the upstanding arms 12 and 13 not only for the purpose of strength and rigidity but also to allow for a sufficient space to accommodate the tap straps. The triangular configuration of the clip 10 of this invention may be modified for the use of different materials and different electrical conductors. Excellent results have been obtained when the triangular configuration approximates a right triangle where the arm members 12 and 13 are each at an angle of about 45° with the horizontal and the projected apex is a 90° angle. However, these angles may be varied so that the triangular configuration may approach an isosceles triangle. While some modification from the triangular configuration to the elliptical may be contemplated, the triangular configuration provides the better supporting action, distribution of stresses and appropriate bending. Alternatively the clip of this invention may be partially formed by the anvil tool. For example, the strip of FIG. 3 may be formed into a V shape and an anvil tool used to further form the clip through its triangular configuration during the crimping process.

While the symmetrical clip of the present invention has many uses in addition to the electrical connection application, it is the latter application which is a primary application. An electrical application may require a further main lead or conductor to be suitably attached to the clip which, in turn, fastens a number of conductors on taps together as described. The symmetrical design of this clip may be suitably modified for the use of a barrel or sleeve retaining means for the main conductor. This feature is best described with respect to FIGS. 7 and 8.

Figure 7:
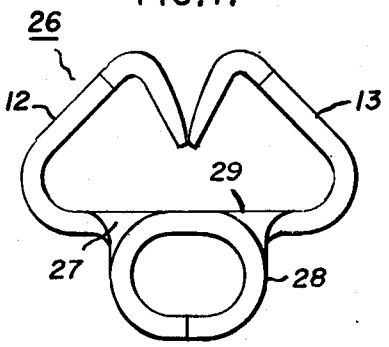
FIG. 7 is an end elevational view of a modified clip of FIG. 1 with a lead sleeve.
Figure 8:
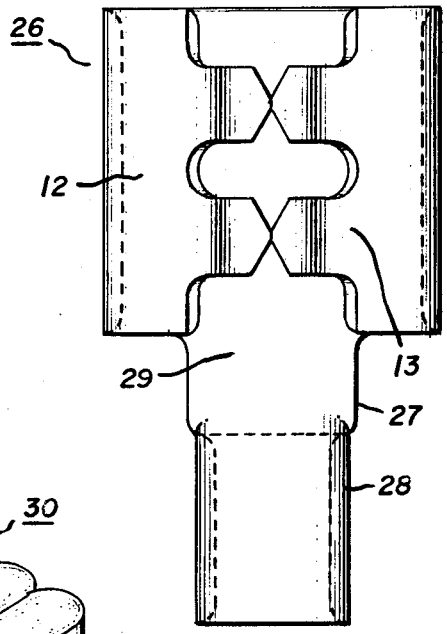
FIG. 8 is a top view of the clip of FIG. 7.

Referring now to FIG. 7 the clip 26 of this modification includes an extending shank portion 27 which extends in a direction parallel to the opening of the symmetrical clip and in the same vertical plane. This shank portion 27 is formed into a sleeve section 28 whose axis is below the axis of the clip opening (FIG. 7), e.g., the clip is formed from a strip member by an upward folding of the arm members 12 and 13 and a downward folding of the sleeve section, both of which are served by a common horizontal section 29. The oblong configuration of the sleeve aids dual lead threading.

Figure 9:
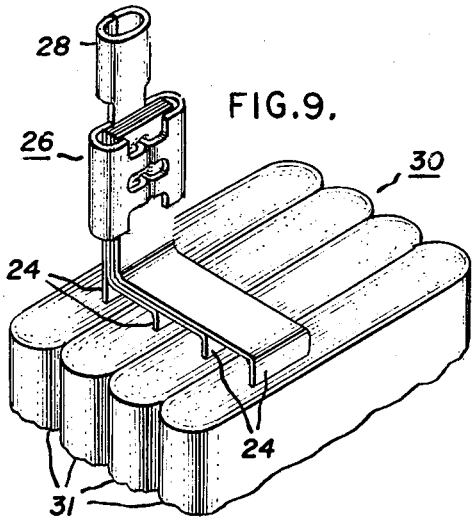
FIG. 9 is an isometric view of the clip of FIGS. 7 and 8 in an operative embodiment of joining capacitor leads.

The offset relationship of clip and sleeve is well adapted for use of the clip to connect electrical capacitor tap straps together, and plural capacitor rolls together. An exemplary illustration is given in FIG. 9. Referring now to FIG. 9, a capacitor section 30 may include a number of roll sections 31 each of which has one or more tap straps 24 protruding therefrom. By way of example a capacitor tap strap may be tinned copper or aluminum of about 0.5 inches wide and 0.0035 inches thickness. Tap straps 24 are placed together in a vertical position as indicated and the clip 26 of this invention is positioned thereon. As can be seen, no presetting or fitting is required, the clip is self holding and aligning. The crimping tool is applied for operation of the clip as described. While some misplacement of the taps can take place, the encircling arm members concept limits the deplacement, prevents lateral sliding and provides accurate penetration without tap fracturing.

Figure 10:
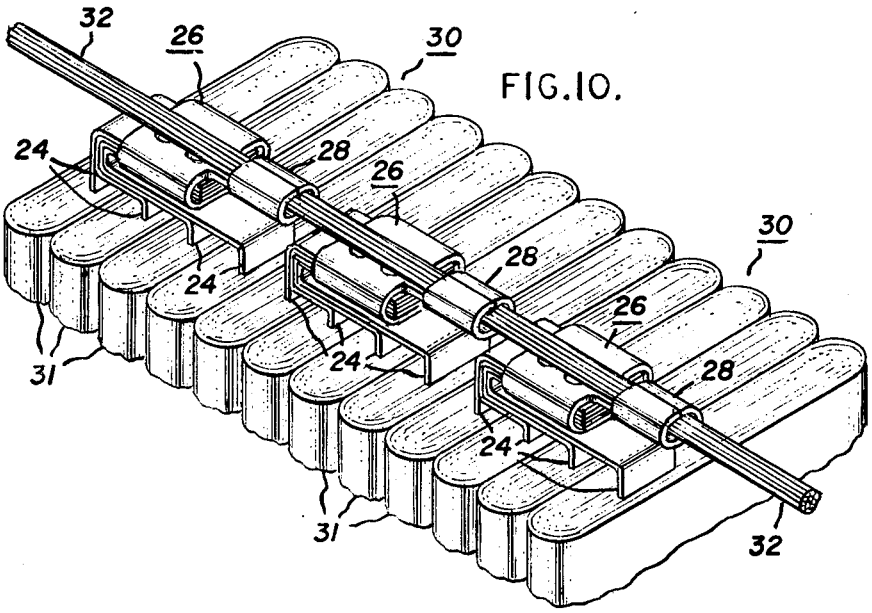
FIG. 10 is an isometric view of a plurality of clips of this invention in an operative embodiment of joining tap straps with a common lead.

Thereafter the tap straps 24 with the clip 26 attached is folded to the horizontal position as indicated in FIG. 10. Referring now to FIG. 10 there is illustrated a number of capacitor sections 30 each section comprising a plurality of capacitor rolls 31 where tap straps 24 are connected by a clip 26 of the present invention. As can be seen, the main conductor or lead 32 projects continuously through the clip sleeve 28. Because of the offset relationship of the sleeve 28 the conductor 32 is easily threaded through the sleeves 28 and facilitates the insertion of a crimping tool thereunder to crimp the sleeve against the conductor 32.

Prior art clips are known to mechanically fail at about 4500 amps per tap because the physical forces are sufficiently great to significantly loosen the connection or open the clip. Where the number of tap straps increase, the ampere rating of the clip markedly decreases. In the practice of this invention as many as 30 of the above described capacitor tap straps have been effectively joined by the clip of this invention. Current tests indicate that the clip of this invention have successfully withstood currents approaching 90,000 to 100,000 amperes. The clip of this invention was compared to prior art clips by having each clip fasten together 30 capacitor tap straps as described. The prior art clip failed by physical opening at about 4500 to 4700 amps per tap. The clip of this invention carried from 6,000 to 6,667 amps per tap without physical opening, at which point, while the clip did not fail, the tap metal melted at these extremely high current levels.

The clip of the present invention is differentiated from book type clips which have limited tap carrying ability, suffer from skewing and failure of penetration and crack taps when not well centered. An important advantage of the clip of this invention in mass production efforts, is that the piercing ends are protected on all sides so that when loosely packaged in containers the clip piercing ends do not become entangled as they do with the book type clips. Continuous use and handling is expedited by this lack of tangling.

While this invention has been disclosed with respect to particular embodiments thereof, numerous modifications may be made by those skilled in the art without departing from its true spirit and scope. Therefore, it is intended that the appended claims cover all such modifications and variations which come within the true spirit and scope of the present invention.

What is claimed as new and desired to be secured by Letters Patent of the United States is:

1. A clip type connector adapted to connect a plurality of electrical conductor laminae together comprising, (a) a metal strip having a central aperture therethrough, (b) said strip having at its opposite ends formed with piercing tang members projecting therefrom, (c) said strip having opposite end portions thereof folded upwardly as upstanding arm members which provide a generally triangular configuration to define a base member having said central aperture therein, (d) said piercing tang members being folded inwardly towards said aperture in said base member and abutting each other to form a V section, (e) whereby when a plurality of conductor laminae are inserted into said triangular configuration a crimping tool forces said piercing tangs through said laminae and said aperture to be clinched to said member.

2. The invention as recited in claim 1 wherein said strip includes a plurality of similar opposed tang members on each end of said strip and an aperture for each opposed pair of tang members.

3. The invention as recited in claim 2 wherein the centerline of said apertures and the centerline of the opposed tang members for said apertures are coincident.

4. The invention as recited in claim 1 wherein the triangular configuration comprises an isosceles triangle.

5. The invention as recited in claim 2 wherein said apertures are necked apertures.

6. The invention as recited in claim 4 wherein the length of an arm member, not including the tang member is about one-half of the length of said base member.

7. A clip type connector adapted to connect a plurality of conductor laminae together comprising, (a) a rectangular metal strip, (b) said strip having at each end thereof a lateral row of tang members which project axially from and in the plane of strip, (c) the centerline of one tang member on one end of the strip passing through the centerline of a tang member on the other end of the strip, (d) said strip having a lateral row of centralized apertures therethrough the centerlines of each of which are coincident with the centerline of an opposed pair of tang members, (e) each end portion of said strip being folded upwardly into a right triangular configuration defining upstanding arm members and a base member with said apertures therein, (f) each pair of said opposed tang members being folded inwardly towards an aperture to meet thereabove in V shaped abutting relationship, (g) whereby when an anvil presses on the clip type connector to deform said triangular configuration, the abutting tang members retain their abutting relationship while piercing said conductors and entering said apertures while deforming the triangular configuration.

8. The invention as recited in claim 7 wherein said strip includes a centralized laterally extending shank portion to provide a T-shaped configuration, and the upright section of the T is folded into a sleeve member whose axis is on the side of the base member opposite to the side of the triangular configuration.

9. The invention as recited in claim 8 wherein said tang members are of a width slightly less than the diameter of an aperture, and the length of the tang members is sufficient to penetrate the conducting laminae and an aperture.

10. The invention as recited in claim 4 wherein said triangle is a right triangle.

* * * * *